US012416157B2

(12) United States Patent
Grønbæk

(10) Patent No.: US 12,416,157 B2
(45) Date of Patent: Sep. 16, 2025

(54) METHOD FOR MOUNTING A ROOF WINDOW, A KIT FOR USE IN THE METHOD, AND A ROOF WINDOW

(71) Applicant: VKR Holding A/S, Hørsholm (DK)

(72) Inventor: Kristian Strand Grønbæk, Gedved (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 18/849,491

(22) PCT Filed: Mar. 31, 2023

(86) PCT No.: PCT/DK2023/050088
§ 371 (c)(1),
(2) Date: Sep. 21, 2024

(87) PCT Pub. No.: WO2023/186251
PCT Pub. Date: Oct. 5, 2023

(65) Prior Publication Data

US 2025/0109592 A1 Apr. 3, 2025

(30) Foreign Application Priority Data

Mar. 31, 2022 (DK) ..... PA 2022 70173

(51) Int. Cl.
*E04D 13/03* (2006.01)
*E04D 13/147* (2006.01)

(52) U.S. Cl.
CPC ..... *E04D 13/031* (2013.01); *E04D 13/1475* (2013.01)

(58) Field of Classification Search
CPC ..... E04D 13/031; E04D 13/0459; E04D 13/1475
See application file for complete search history.

(56) References Cited

U.S. PATENT DOCUMENTS 4,703,592 A * 11/1987 Sampson ..... E04D 13/0305 52/20
4,972,638 A 11/1990 Minter
(Continued)

FOREIGN PATENT DOCUMENTS

EP 2333191 6/2011
EP 2333191 A2 * 6/2011 ..... E04D 13/1475
(Continued)

OTHER PUBLICATIONS

International Search Report issued in connection with International Application No. PCT/DK2023/050088.
(Continued)

*Primary Examiner* — Christine T Cajilig
(74) *Attorney, Agent, or Firm* — Merek, Blackmon & Voorhees, LLC

(57) ABSTRACT

A method for mounting a roof window (1) in a roof structure (11) comprising a roofing material (112), said roof window comprising a frame (2), a sash (3) carrying a pane element (4), where the method comprises the steps of A) Arranging the roof window (1) in an opening in the roof structure (11), B) Arranging a plurality of flashing members so that they cover a joint between the frame (2) of the roof window (1) and the roof structure (11) with a top flashing member (1011) extending along the top frame member (21), a bottom flashing member (1014) extending along the bottom frame member (24), and at least two side flashing members (1012, 1013) extending along the side frame members (22, 23), and during step B) a flange (1017) of at least one side flashing member (1012, 1013) is inserted into a flashing reception groove (85) in the outer side (20*o*) of at least one side frame member (22, 23), said flashing reception groove extending in the length direction (L) of the side frame member.

20 Claims, 5 Drawing Sheets

(56) References Cited

U.S. PATENT DOCUMENTS

| | | | | |
|---|---|---|---|---|
| 5,207,036 | A | 5/1993 | Sampson et al. | |
| 5,355,644 | A | 10/1994 | Guhl et al. | |
| 6,457,279 | B1 * | 10/2002 | Jacobsen | E04D 13/1475 52/60 |
| 2006/0272232 | A1 | 12/2006 | Fooks | |
| 2009/0031640 | A1 * | 2/2009 | Elmes | E04D 13/1475 52/60 |

FOREIGN PATENT DOCUMENTS

| | | | | |
|---|---|---|---|---|
| EP | 2508690 | | 10/2012 | |
| EP | 3012381 | A1 * | 4/2016 | E04D 13/031 |
| EP | 3404162 | A1 * | 11/2018 | |
| WO | WO-2021058073 | A1 * | 4/2021 | E04D 13/03 |

OTHER PUBLICATIONS

Written Opinion issued in connection with International Application No. PCT/DK2023/050088.
International Preliminary Report on Patentability issued in connection with International Application No. PCT/DK2023/050088.

* cited by examiner

METHOD FOR MOUNTING A ROOF WINDOW, A KIT FOR USE IN THE METHOD, AND A ROOF WINDOW

TECHNICAL FIELD

The present invention relates to a method for mounting a roof window in a roof structure comprising a roofing material, said roof window comprising a frame, a sash carrying a pane element, and said frame comprising a top frame member, two side frame members and a bottom frame member, said frame members together defining a frame opening and a frame plane and each extending in a length direction and each having an outer side facing away from the frame opening, where said method comprises the steps of: A) Arranging the roof window in an opening in the roof structure; and B) Arranging a plurality of flashing members so that they cover a joint between the frame of the roof window and the roof structure with a top flashing member extending along the top frame member, a bottom flashing member extending along the bottom frame member, and at least two side flashing members extending along the side frame members, each flashing member being arranged with an inner section adjacent to a frame member and an outer section extending from the inner section away from the frame. The invention further relates to a kit for use in the method and to a roof window.

BACKGROUND ART

When installing windows in a roof structure of a building it is necessary to make an opening in the roof structure and subsequently to re-establish the weather proofing of the building otherwise provided by the roof structure. For this purpose, the joint between the roof window and the roof structure is covered by covering assembly including flashing and cladding members. To achieve the best possible weather proofing it is essential that the covering assembly is mounted correctly and that it subsequently stays in place, even during heavy winds and when affected by big temperature variations.

SUMMARY OF INVENTION

With this background, it is therefore an object of the invention to provide an improved method for mounting a roof window with a covering assembly and a roof window with an improved covering assembly.

This and further objects are achieved with a method of the kind mentioned in the introduction which is furthermore characterised in that during step B) a flange of at least one side flashing member is inserted into a flashing reception groove in the outer side of at least one side frame member, said flashing reception groove extending in the length direction of the side frame member.

By inserting flanges of the side flashing members in one or more flashing reception grooves extending in the length direction of the side frame members, the side flashing members can be arranged precisely in the intended height in a height direction extending perpendicular to the frame plane. This ensures that the side flashing members are arranged in the intended height in relation to the roof structure and may also contribute to neighbouring flashing members being arranged correctly in relation to each other. As is well-known to the skilled person, neighbouring flashing members typically overlap and a tight contact between the overlapping parts of the flashing members may contribute to the tightness of the finished covering assembly. For this purpose, two or more flashing members may be arranged so that their flanges project into the same flashing reception groove and so that the flanges overlap inside the flashing reception groove.

It is presently considered advantageous that the flashing members are displaced in a direction parallel to the frame plane for insertion of the flanges into the flashing reception groove(s). For this purpose, the flange extends in a direction parallel to the frame plane in the mounted state. This will for example allow a flange on a corner section of a top flashing member to be inserted into the same flashing reception groove in a side frame member as a side flashing member by displacement of the top flashing member in a direction parallel to the side frame member. Other insertion angles are, however, possible, depending for example on the shape of the side flashing members and on how deep in the roof structure the roof window is mounted, including a swinging motion, where the side flashing member are turned about the length direction during insertion.

The flashing reception groove may be provided in a traditional frame member, such as a wooden frame member, a frame member made from a wood-based core encased in a polymer, or a frame member made by extrusion, but is also possible to provide the frame with an interface unit and forming the flashing reception groove therein. The interface unit may for example be an elongate member, such as a rail, provided on an exterior side of a traditional frame member and extending in the length direction thereof.

In one embodiment, the method further comprises the step of: C) shaping the outer sections of the side flashing members so that they match the shape of the roof structure and/or the roof material. The side flashings may then for example be provided with the outer section extending perpendicular to the flange and be arranged with the outer section initially extending perpendicular to the frame plane. This may for example be advantageous in roofs with a flat roofing material, such as slate, where it is common practice to use several smaller side flashing members, which are arranged alternating with plates of slate. A plate of slate can then be arranged while the outer section projects upwards, perpendicular to the frame plane and to the plane of the roof, and the outer section can then be folded down onto the plate of slate and shaped to follow it precisely. In this way it is possible to not only compensate for natural variations in the shape of the roofing material, but also to compensate for smaller differences in the height of the roofing material relative to the position of the roof window and hence the flashing reception groove, which may for example result from different building traditions, such as the use of laths of different dimensions in different countries. Shaping of the outer section may also be advantageous where the roofing material is an undulating roofing material, such as tiles, where the side flashing members will typically project underneath the roofing material. The shaping may then be used for adapting the shape of the side flashing member to the shape of the roof structure supporting the roofing material.

Depending on the material used for the flashing members, the shaping may be done by hand or using a tool, such as rubber hammer. Flashing members made from aluminium can usually be deformed by hand, by simply pushing them firmly against the roofing material and/or roof structure.

The top and/or bottom flashing member may be provided with corner sections extending in continuation of the side flashing members when seen in the direction of inclination of the roof structure, and it may also be advantageous to shape such corner sections as described with reference to the side flashing members above.

In one embodiment, three or more side flashing members are inserted into the flashing reception groove in the outer side of each side frame member, and each side flashing member is arranged so that it overlaps with another side flashing member. If, in that case, the inner section of each side flashing member comprises a gutter extending in the length direction and said gutter has the same depth over the entire extend of the side flashing member and the same depth in all side flashing members, a continuous gutter extending along length of the side frame member can formed. From a distance, for example if view by a person standing on the ground and looking up on the roof, this gutter may appear as being formed by a single side flashing member.

To facilitate mounting of the flashing member, the flange may comprise a marking indicating an intended insertion depth of the flange into the flashing reception groove. During mounting, the displacing of the flashing member is continued until the flange is inserted so deep in the flashing reception groove that the marking reaches or is hidden by the side frame member. The marking may for example be a printed indication on the flange but may also be in the form of perforations on the flange. Perforations may have the added advantage of reducing heat transfer via the flange. It is also possible to provide a click-function providing an audio and/or tactile feed-back when proper insertion has been achieved.

Alternatively, or additionally, if the inner section of the side flashing member comprises a gutter extending in the length direction and configured for extending along a side frame member between the frame and the roofing material in the mounted state, it is possible to continue the insertion of the flange until the gutter engages with the outer side of a side frame member.

The method may comprise the further step of D) displacing the side flashing member in a direction parallel with the length direction of the side frame member following step B) and before step C), if applicable. This step may be performed to achieve an overlap between flashing members, for example for interconnecting gutters into one continuous gutter as described above.

To facilitate a shaping of the outer section of a side flashing member, the inner section may be retained using a tool during step C). This may for example help to prevent the flange from being pulled out of the flashing reception groove during the shaping process and/or help to prevent a deformation of the inner section of the side flashing member.

If the inner section comprises a gutter, the tool may be arranged in the gutter during use, and it is presently considered advantageous that the tool has a width corresponding to the width of the gutter in a direction perpendicular to the length direction, as this may help prevent deformation of the gutter. It is, however, also possible to use the tool for forming a gutter before, during, or after the shaping in step C).

The length of the tool as measured in the length direction during use may correspond to the length of the side flashing member. Using a shorter tool may be advantageous with side flashing members extending substantially along the entire length of the side frame member. Using a longer tool may be advantageous when mounting several shorter side flashing members, where mutual adaptation may be desired. The tool may comprise a scale or length indication, which may be used for determining if an intended overlap between neighbouring flashing members has been achieved.

In a second aspect of the invention, the object is achieved with a kit for mounting a roof window using the method described above, comprising a roof window, a plurality of flashing members, and a tool for retaining the inner sections of the side flashing members during a shaping of the outer sections of flashing members.

In a third aspect of the invention, the object is achieved with a roof window mounted in a roof structure comprising a roofing material, said roof window comprising a frame, a sash carrying a pane element and a covering assembly, said frame comprising a top frame member, two side frame members and a bottom frame member, said frame members together defining a frame opening and a frame plane and each extending in a length direction and each having an outer side facing away from the frame opening, and said covering assembly comprising a plurality of flashing members covering a joint between the frame and the roof structure and a plurality of cladding members covering a part of the sash, where a top flashing member extends along the top frame member, a bottom flashing member extends along the bottom frame member, and at least two side flashing members extend along the side frame members, and where each flashing member is arranged with an inner section adjacent to a frame member and an outer section extending from the inner section away from the frame, characterised in that each of the side frame members comprises a flashing reception groove in the outer side, said flashing reception groove extending in the length direction of the side frame member, and that at least one side flashing member comprises a flange inserted into the flashing reception groove.

Embodiments and advantages described with reference to one aspect of the invention also apply to the other aspects of the invention and vice versa.

BRIEF DESCRIPTION OF DRAWINGS

In the following description embodiments of the invention will be described with reference to the schematic drawings, in which.

DESCRIPTION OF EMBODIMENTS

Figure 1:
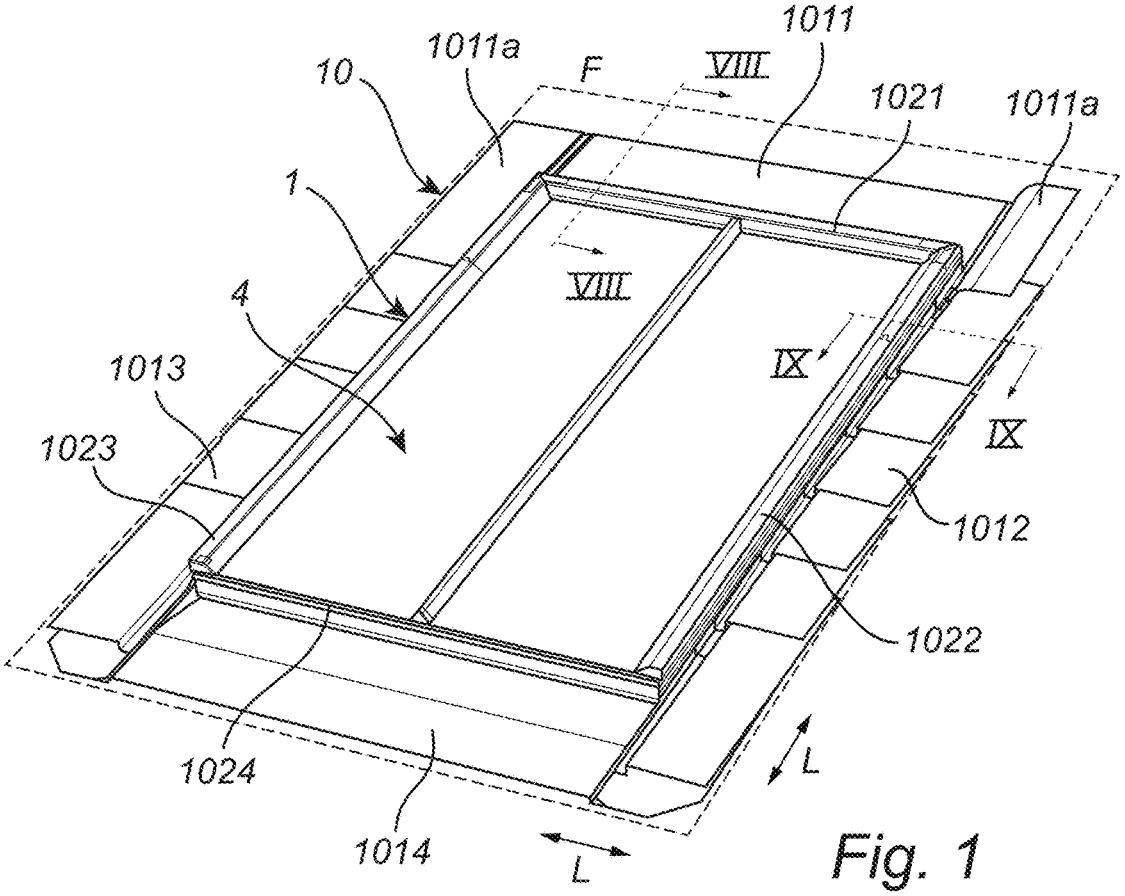
FIG. 1 is a perspective view of a roof window with a covering assembly.

Referring initially to FIG. 1, a roof window 1 is shown with a covering assembly 10, where the right-hand side of the top flashing member 1011 is shown in a state of delivery, before adaptation to the shape of a roofing material used alongside the roof window as will be explained later. The roof window 1 is shown in an inclined position as it is intended for being mounted in an inclined roof structure.

In addition to the top flashing member 1011, the covering assembly comprises a plurality of side flashing members 1012, 1013, a bottom flashing member 1014 and a plurality of cladding members 1021, 1022, 1023, 1024 each covering a part of the sash carrying the pane element 4.

The roof window 1 comprises a frame (not visible in FIG. 1), and the top flashing member 1011, the side flashing members 1012, 1013, and the bottom flashing member 1014 extend in a respective length direction L along top, side and frame members, respectively. The frame members together defining a frame opening covered by the pane element 4 and a frame plane F.

In the embodiment in FIG. 1, the top flashing member 1011 comprises a corner section 1011*a* at each end, said corner section extending along a side of the roof window and overlapping with a flashing member 1012, 1013. The top flashing member may thus be said to have the shape of an inverted U embracing the upper part of the roof window when mounted in an inclined roof structure, i.e. the part being arranged uppermost when seen in the direction of inclination of the roof structure (cf. also FIGS. 2, 7 and 13).

The cladding members 1021, 1022 of the covering assembly 10 may be pre-mounted on the roof window 1 or be mounted after the mounting of the flashing members. This is not essential to the present invention and will therefore not be described in further detail here.

Figure 2:
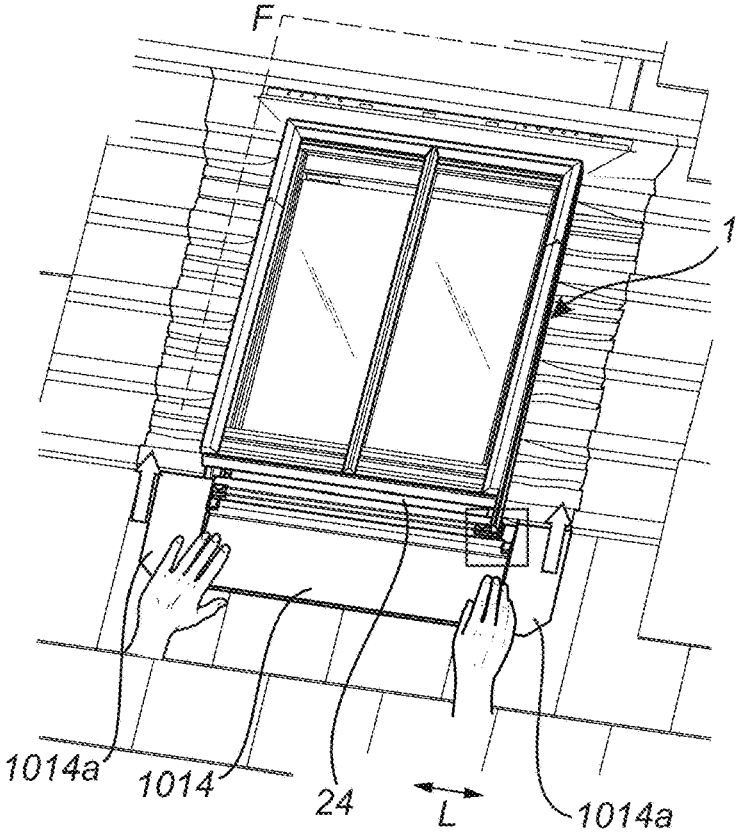
FIG. 2 is a perspective view showing the mounting of a bottom flashing member.

The mounting of the flashing members starts with the mounting of the bottom flashing member 1014, and, as shown in FIG. 2, it is displaced in a direction parallel to the frame plane F and perpendicular to the length direction L of the bottom frame member 24.

Figure 3:
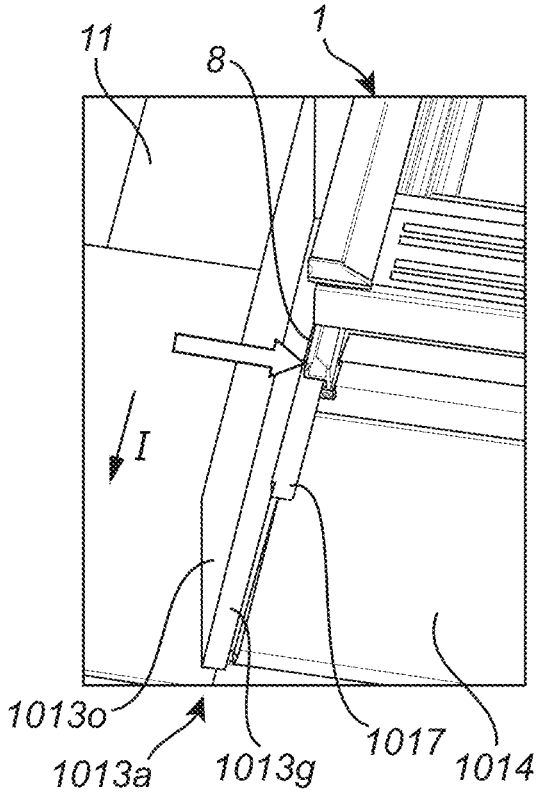
FIG. 3 is a perspective view showing a first step in the mounting of a lowermost side flashing member.

In FIG. 3, a lowermost side flashing members 1013*a* is mounted at the left-hand side of the roof window by upwards displacement along the direction of inclination I of the roof structure 11, inserting the flange 1017 into a flashing reception groove in an interface unit 8 arranged on the side frame member. The lowermost side flashing members 1012*a* for use at the right-hand side of the roof window is shown in FIG. 6.

Figure 4:
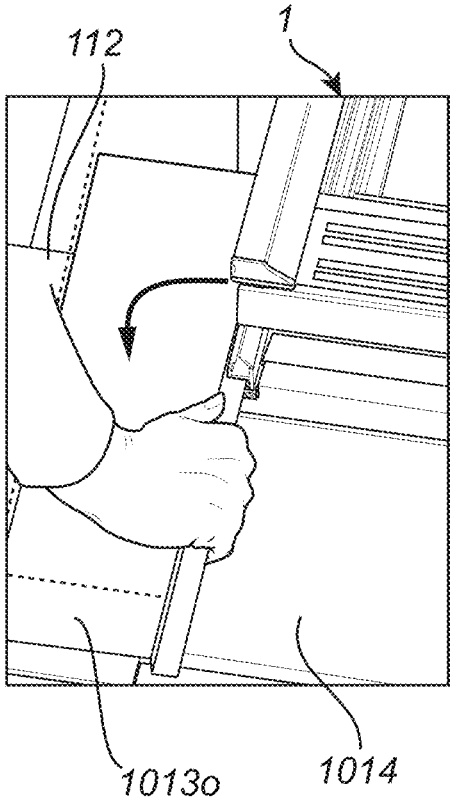
FIG. 4 is a perspective view showing a second step in the mounting of a lowermost side flashing member.

In FIG. 4 the outer section 1013*o*, which was initially in an upright state as shown in FIG. 3, is bent down by hand, thereby bringing it into contact with the roofing material 112, which is here slate, thus shaping the lowermost side flashing members 1013*a* to the shape of the roofing material.

Figure 5:
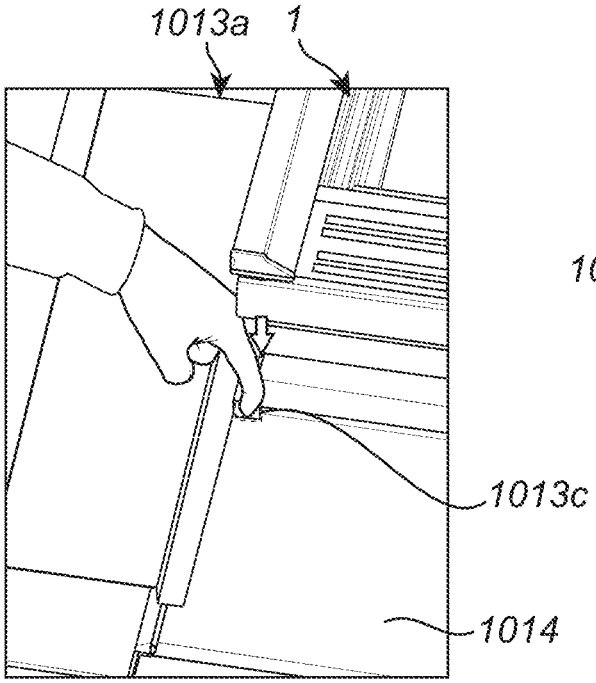
FIG. 5 is a perspective view showing a third step in the mounting of a lowermost side flashing member.

In FIG. 5 a closure flap 1013*c* on the left-hand side flashing member 1013*a* is bent downwards towards the bottom flashing member 1014, thereby contributing to water-proofing the joint between flashing members and to ensuring the position of the side flashing member 1013*a*. The corresponding closure flap 1012*c* on the right-hand side flashing member 1012*a* is more easily seen in FIG. 6.

Figure 6:
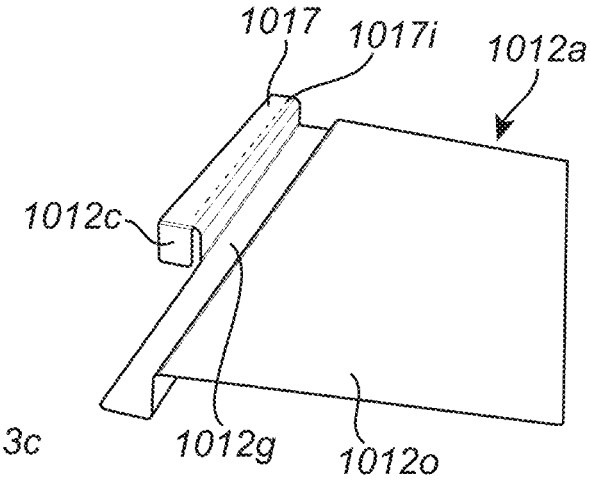
FIG. 6 is a perspective view of a lowermost side flashing member, FIG. 7 corresponds to FIG. 2 but showing the subsequent mounting of side flashing members.

As is also seen in FIG. 6, the lowermost side flashing members 1012*a* comprises a gutter 1012*g*, extending in parallel with the flange 1017 and thus with the side frame member in the mounted state, and a series of perforations 1017*i* in the flange. Both will be described in further detail below.

Figure 7:
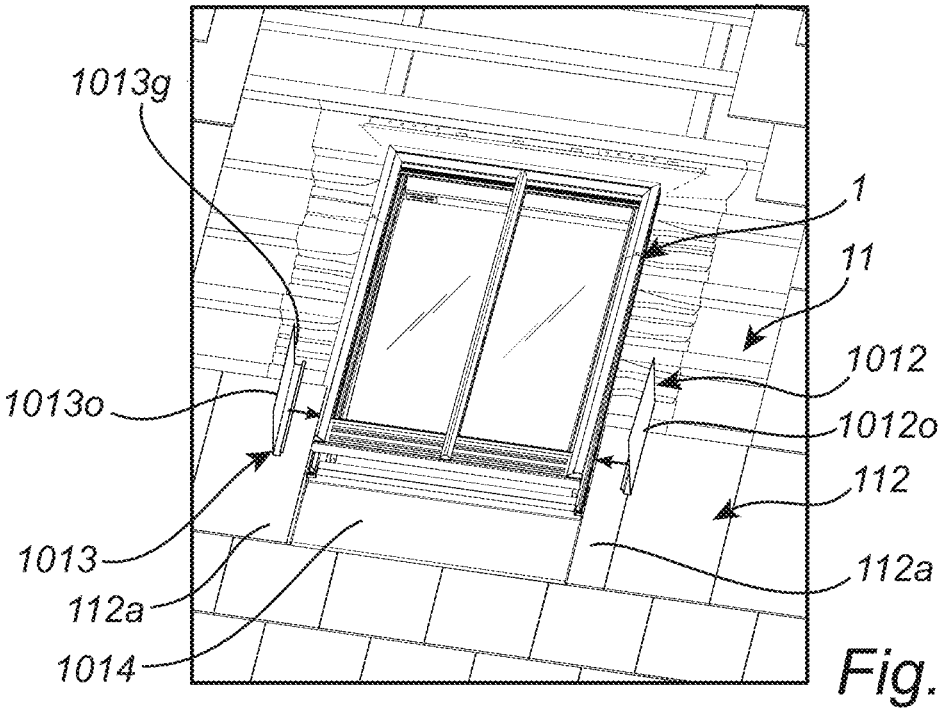

The remaining side flashing members 1012, 1013 are mounted by being displaced from the side, i.e. in a direction perpendicular to the side frame member as shown in FIG. 7. In the embodiment shown several side flashing members are used at each side of the roof window 1, but it is to be understood that the invention also applies to roof windows where the covering assembly only comprises two regular side flashing members 1012, 1013, one at each side of the roof window.

Figure 8:
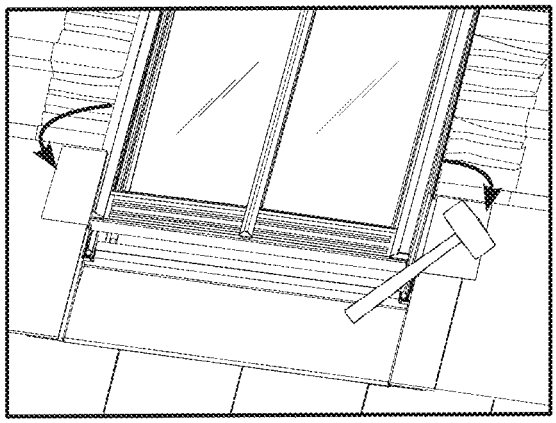
FIG. 8 is a perspective view showing a further stage of the mounting of the side flashing members, FIG. 9 corresponds to FIG. 8 but showing the use of another tool.
Figure 9:
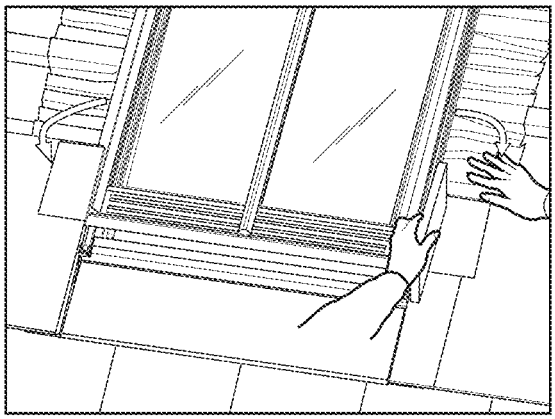
Figure 10:
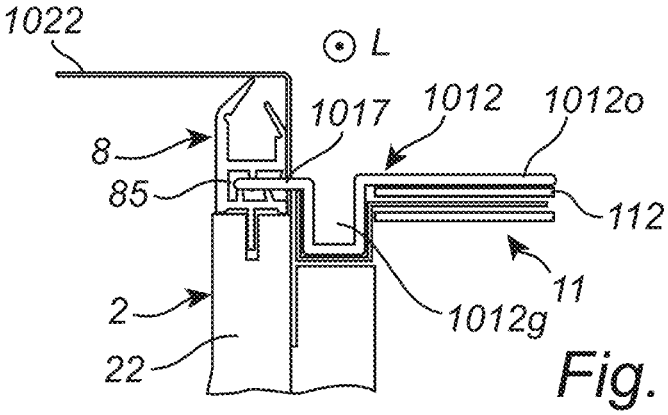
FIG. 10 is a cross-sectional view showing the right-hand side flashing member in the mounted state.

The side flashing members shown in FIG. 7 are initially mounted in a state, where an outer section 1012*o*, 1013*o* configured for resting on the roof structure 11 is in an upright position, and the outer section is then folded down onto the roofing material 112 as shown in FIG. 8 or in FIG. 9, ending up having the shape shown in FIG. 10. This embodiment is particularly well suited for use with flat roofing materials, such as slate, whereas flashing members used with undulating roofing materials, such as tiles, will typically project underneath the roofing material and may therefore be mounted without such a folding down step. The folding down may, however, also be used for adapting the shape of the side flashing member to the shape of a roof structure supporting an undulating roofing material.

The folding down may be performed by hand as in FIG. 4, by use of a rubber hammer as shown in FIG. 8, or by use of a specialized tool as in FIG. 9. The specialized tool is here arranged on the part of the outer section bordering the gutter (not visible in FIG. 9), thereby hindering a deformation of the side of the gutter closest to the outer section. It is, however, also possible to arrange the tool in the gutter, thereby keeping the gutter in place during the shaping and possibly preventing a deformation of the gutter.

Figure 11:
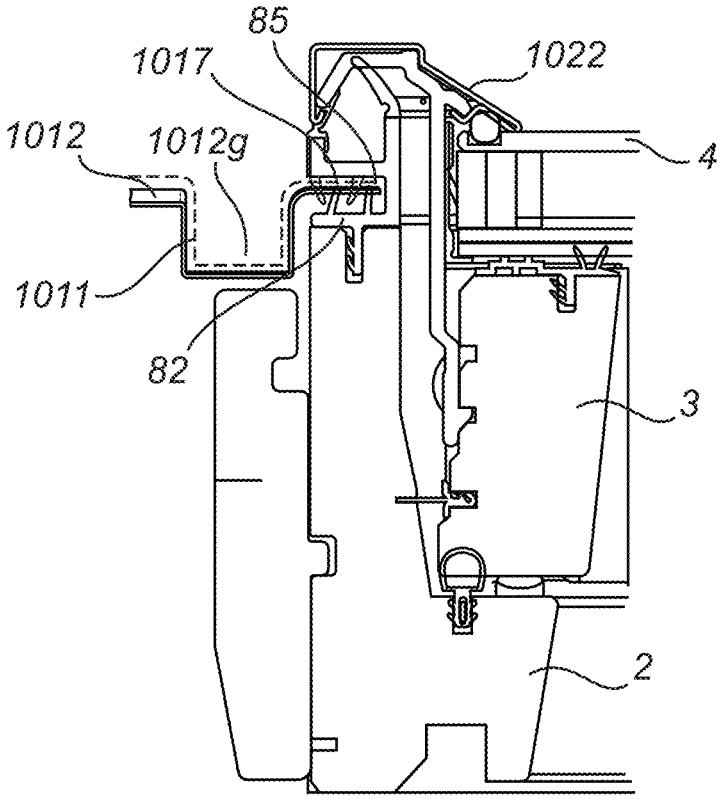
FIG. 11 is a cross-sectional view along the line IX-IX in FIG. 1.
Figure 12:
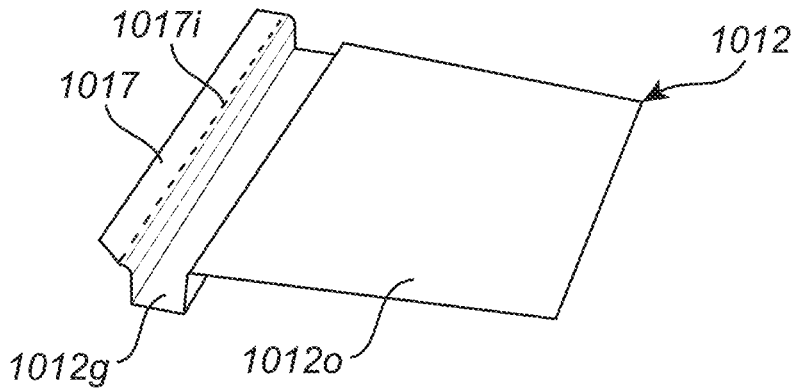
FIG. 12 is a perspective view of a side flashing member, FIG. 13 corresponds to FIG. 7 but showing the subsequent mounting of a top flashing member.

As may be seen in FIGS. 10 and 11, a flange 1017 on the side flashing member 1012 has been inserted into a flashing reception groove 85 in the form of a groove in a side element 82 of an interface unit of the frame 2, and it is to be understood that both the interface unit and the flashing reception groove 85 therein extends in the length direction L of the frame side member 22. Inside the flashing reception groove 85, elastic protrusions 85*a* engage with both sides of the flange 1017, thereby contributing to keeping it in place in the flashing reception groove. In addition to providing friction against the flange, the protrusions may also serve a sealing function. If inserting the flange in a flashing reception groove in a traditional frame member, similar protrusions may be provided by inserting a gasket in the flashing reception groove before inserting the flange.

The flashing reception groove 85 has a height allowing it to accommodate at least two flanges of side flashing members overlapping each other as here shown by the broken line illustrating and overlap with a top flashing member 1011. Side flashing members may overlap in the same way. In this way a continuous gutter extending all the way along the side of the roof window may be formed.

An example of a side flashing member 1012 is shown in FIG. 11. In addition to the outer section 1012*o*, the gutter 1012*g*, and the flange 1017, it has a series of marking 1017*i* in the flange as also mentioned with reference to FIG. 6. During mounting these markings serve as a visual indication if the flange has been inserted sufficiently deep into the flashing reception groove 85 for the side flashing member to be in the intended position. In the embodiment shown, the markings will be aligned with the side of the interface unit at correct insertion, but they may also be positioned such that they are to be hidden inside the flashing reception groove at correct insertion. This particularly advantageous if the markings are perforations. Printed lines or dots or other similar markings may also be used.

Figure 13:
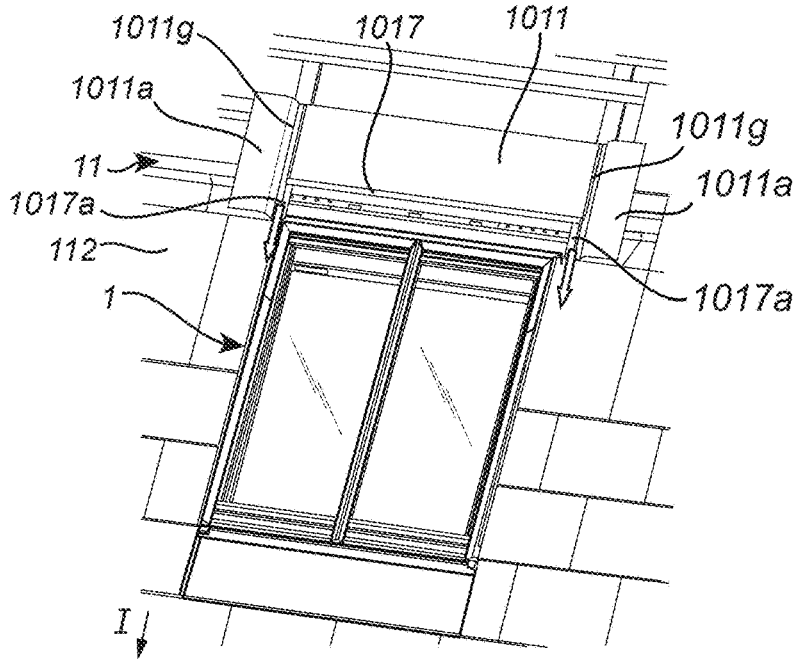

Turning now to FIG. 13 the mounting of the top flashing member 1011 is shown. As may be seen, it is mounted in the same way as described with reference to the bottom flashing member in the description of FIG. 2, only displacing it downwards instead of upwards as seen in the direction of inclination I of the roof structure 11.

Figure 14:
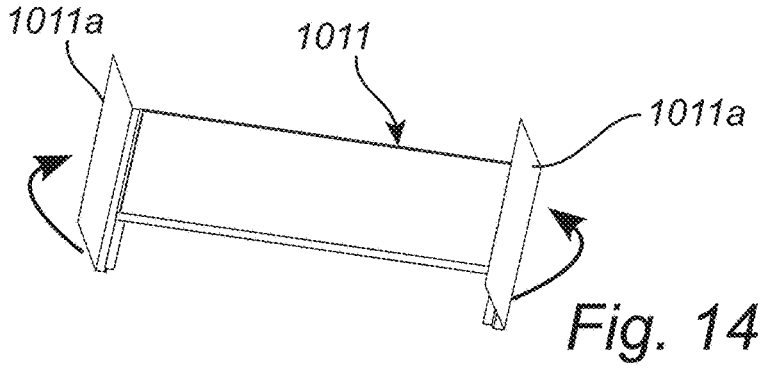
FIG. 14 is a perspective view of a top flashing member.

As shown in FIG. 14, corners section 1011*a* of the top flashing member 1011 can be in an upright initial state as described above or be bent to this state before mounting. They may, however, also be in an initial state requiring less deformation as shown at the right-hand side in FIG. 1 and in FIG. 13.

Figure 15:
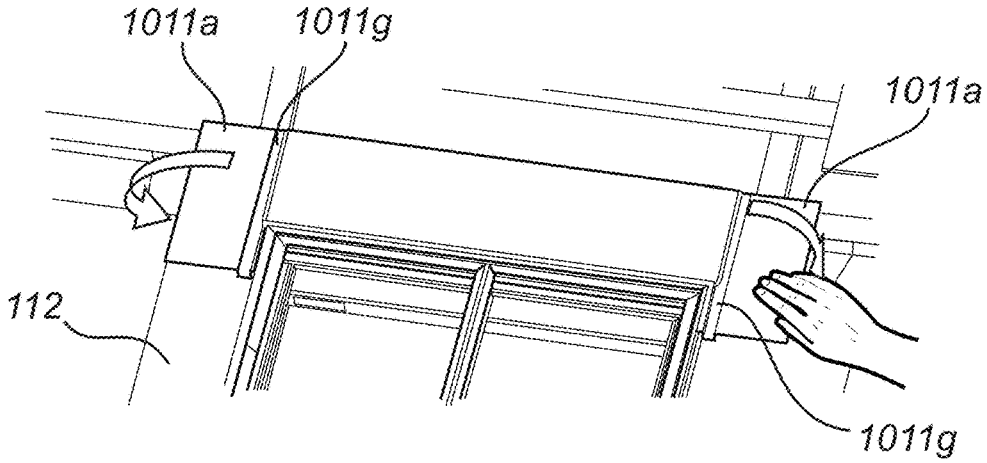
FIG. 15 is a perspective view showing a further stage of the mounting of the top flashing member.

As shown in FIG. 15, to finish the installation of the flashing members, the corner sections 1011*a* are folded down onto the roofing material 112 in the same way as described with reference to the outer sections of the side flashing members. In FIG. 15 the folding is shown as being done by hand, but it could also be done using a tool.

The top flashing member 1014 also comprises gutters 1011*g*, which in the mounted state are arranged in continuation of the gutters 1012*g*, 1013*g* in the side flashing members 1012, 1013. In the mounted state these gutters 1011*g*, 1012*g*, 1013*g* thus form one continuous gutter allowing water to be drained down along the sides of the roof window 1.

Gutter 1011*g*, 1012*g*, 1013*g* may contribute to a correct alignment of the flashing members in relation to each other.

The top flashing member 1011 and the bottom flashing member 1014 also comprises flanges 1017, which are inserted into a flashing reception groove along the top frame member and the bottom frame member, respectively, as described with reference to the side flashing members above.

Components of the roof window 1 are easily disassembled and each component may in principle be reused, be recycled by appropriate environmentally responsible disposal means, or the material be recovered for other uses.

LIST OF REFERENCE NUMERALS

1 Roof window
10 Covering assembly
1011 Top flashing member
1011*a* Corner section
1011*g* Gutter
1012 Side flashing member
1012*a* Lowermost side flashing member
1012*c* Closure flap
1012*g* Gutter
1012*o* Outer section
1013 Side flashing member
1013*a* Lowermost side flashing member
1013*g* Gutter
1013*o* Outer section
1014 Bottom flashing member
1014*a* Corner section
1017 Flange
1017*a* Corner flange
1017*i* Marking
1021 Cladding member
1022 Cladding member
1023 Cladding member
1024 Cladding member
11 Roof structure
112 Roofing material
112*a* Slate plate
2 Frame
20*o* Outer side of frame member
21 Top frame member
22, 23 Side frame member
24 Bottom frame member
200 Frame opening
4 Pane element
8 Interface unit
81 Top element
82 Side element
85 Flashing reception groove
85*a* Protrusion
F Frame plane
I Direction of inclination
L Length direction

The invention claimed is:

1. A method for mounting a roof window in a roof structure comprising a roofing material, said roof window comprising a frame, a sash carrying a pane element, and said frame comprising a top frame member, two side frame members and a bottom frame member, said frame members together defining a frame opening and a frame plane and each extending in a length direction and each having an outer side facing away from the frame opening, where said method comprises the steps of A) Arranging the roof window in an opening in the roof structure, B) Arranging a plurality of flashing members so that they cover a joint between the frame of the roof window and the roof structure with a top flashing member extending along the top frame member, a bottom flashing member extending along the bottom frame member, and at least two side flashing members extending along the side frame members, each flashing member being arranged with an inner section adjacent to a frame member and an outer section extending from the inner section away from the frame, and during step B) a flange of at least one side flashing member is inserted into a flashing reception groove in the outer side of at least one side frame member, said flashing reception groove extending in the length direction of the side frame member, that three or more side flashing members are inserted into the flashing reception groove in the outer side of each side frame member, that each side flashing member is arranged so that it overlaps with another side flashing member, characterised in that the inner section of each side flashing member comprises a gutter extending in the length direction, and that said gutter has the same depth over the entire extent of the side flashing member and the same depth in all side flashing members, so that when the side flashing members are mounted, a continuous gutter extending along length of the side frame member is formed.

2. The method according to claim 1, further comprising the step of:

C) shaping the outer sections of the side flashing members so that they match the shape of the roof structure and/or the roof material.

3. The method according to claim 1, where the at least one side flashing member comprises a marking on the flange and where the insertion of the flange in step B) is continued until the marking reaches or is hidden by the side frame member.

4. The method according to claim 1, where the insertion of the flange in step B) is continued until the gutter engages with the outer side of the side frame member.

5. The method according to claim 2, further comprising the step of:

D) displacing the side flashing member in a direction parallel with the length direction of the side frame member following step B) and before step C).

6. The method according to claim 2, where the inner section is retained using a tool during step C).

7. The method according to claim 6, where the tool is arranged in the gutter.

8. The method according to claim 6, comprising the step of:

providing a kit for mounting the roof window including the roof window, the plurality of flashing members, and a tool for retaining the inner sections of the side flashing members during a shaping of the outer sections of the flashing members.

9. A roof window mounted in a roof structure comprising a roofing material, said roof window comprising a frame, a sash carrying a pane element and a covering assembly, said frame comprising a top frame member, two side frame members and a bottom frame member, said frame members together defining a frame opening and a frame plane and each extending in a length direction and each having an outer side facing away from the frame opening, and said covering assembly comprising a plurality of flashing members covering a joint between the frame and the roof structure and a plurality of cladding members covering a part of the sash, where a top flashing member extends along the top frame member, a bottom flashing member extends along the bottom frame member, and at least two side flashing members extend along the side frame members, and where each flashing member is arranged with an inner section adjacent to a frame member and an outer section extending from the inner section away from the frame, and each of the side frame members comprises a flashing reception groove in the outer side, said flashing reception groove extending in the length direction of the side frame member, and that at least one side flashing member comprises a flange inserted into the flashing reception groove, characterised in that the inner sections of at least two neighbouring flashing members comprise a gutter extending along a side frame member between the frame and the roofing material, that the gutter of these two neighbouring flashing members overlap, and that the gutter has the same depth over the entire extent of a side flashing member and the same depth in all side flashing members.

10. The roof window according to claim 9, where the flange extends in a direction parallel to the frame plane.

11. The roof window according to claim 9, where the flashing reception groove is provided in an interface unit extending in the length direction of at least one frame member.

12. The roof window according to claim 10, where the flashing reception groove is provided in an interface unit extending in the length direction of at least one frame member.

13. The method according to claim 2, where the at least one side flashing member comprises a marking on the flange and where the insertion of the flange in step B) is continued until the marking reaches or is hidden by the side frame member.

14. The method according to claim 2, where the insertion of the flange in step B) is continued until the gutter engages with the outer side of the side frame member.

15. The method according to claim 3, where the insertion of the flange in step B) is continued until the gutter engages with the outer side of the side frame member.

16. The method according to claim 3, further comprising the step of:

D) displacing the side flashing member in a direction parallel with the length direction of the side frame member following step B) and before step C).

17. The method according to claim 4, further comprising the step of:

D) displacing the side flashing member in a direction parallel with the length direction of the side frame member following step B) and before step C).

18. The method according to claim 3, where the inner section is retained using a tool during step C).

19. The method according to claim 4, where the inner section is retained using a tool during step C).

20. The method according to claim 7, comprising the step of:

providing a kit for mounting the roof window including the roof window, the plurality of flashing members, and a tool for retaining the inner sections of the side flashing members during a shaping of the outer sections of the flashing members.

* * * * *